United States Patent [19]

Anderson

[11] 4,344,257

[45] Aug. 17, 1982

[54] WINDOW STRUCTURE

[76] Inventor: Richard N. Anderson, 1572 Oak Park Dr., Owensboro, Ky. 42301

[21] Appl. No.: 50,817

[22] Filed: Jun. 21, 1979

[51] Int. Cl.[3] ..... E06B 1/04

[52] U.S. Cl. ..... 49/504; 49/DIG. 1; 52/403

[58] Field of Search ..... 49/65, 62, 63, 163, 49/54, 504, DIG. 1; 160/102; 52/403

[56] References Cited

U.S. PATENT DOCUMENTS

| | | | |
|---|---|---|---|
| 2,734,601 | 2/1956 | Anderson | 49/DIG. 1 |
| 2,755,520 | 7/1956 | Pesonen | 49/65 |
| 3,055,468 | 9/1962 | Horejs et al. | 49/DIG. 1 |
| 3,195,195 | 7/1965 | Mulvaney | 160/102 X |
| 3,579,724 | 5/1971 | Toth | 49/DIG. 1 |
| 3,780,473 | 12/1973 | Kort et al. | 49/62 |
| 4,018,022 | 4/1977 | Fink | 49/DIG. 1 X |

*Primary Examiner*—Kenneth Downey

[57] ABSTRACT

Window structure including a thermal break window frame and a sash coupler for selectively coupling movable window sash in inner and outer windows for movement together. The window frame includes an inner and outer frame portion and an insulating member which are constructed and arranged so that the insulating member is positioned between the inner and outer window frame portions with surface to surface contact therewith over a substantial area extending transversely of the plane of the window structure. The insulating member may be snapped, staked or crimped into assembly with the inner and outer frame portions and rigidly secures the inner and outer window frame portions together. The thickness of the insulating member may vary and it may be solid or hollow in accordance with rigidity and insulating requirements. The sash coupler is secured to a movable sash of the inner window and is formed to selectively engage a projection on a movable sash on the outer window.

13 Claims, 7 Drawing Figures

FIG.1
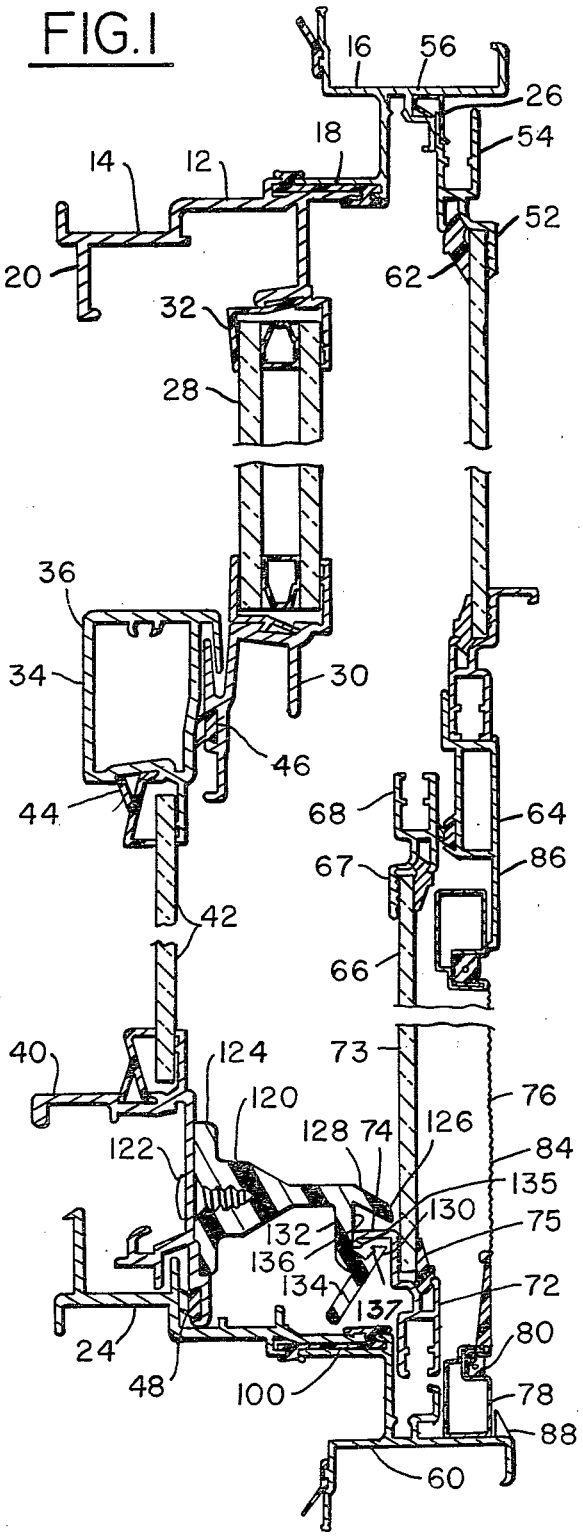
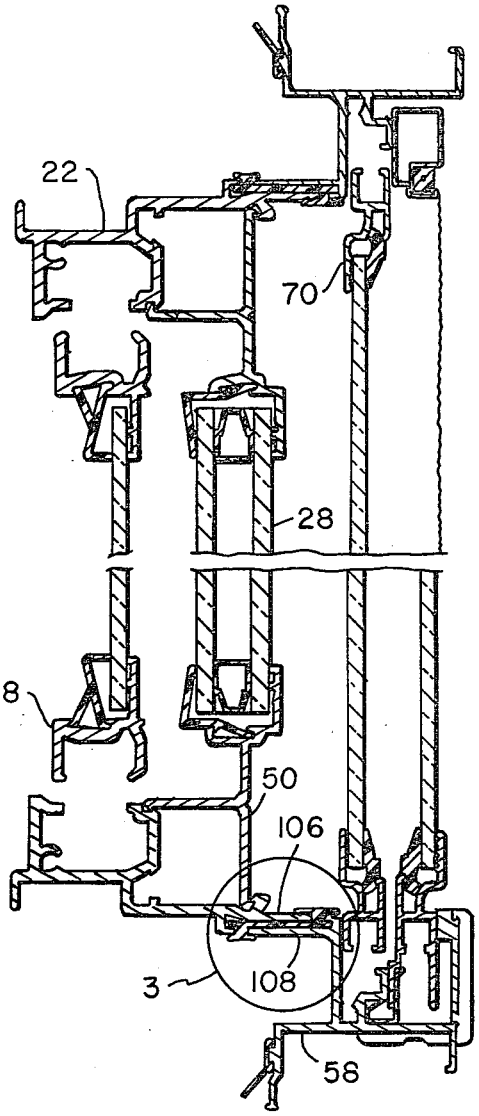
FIG.2

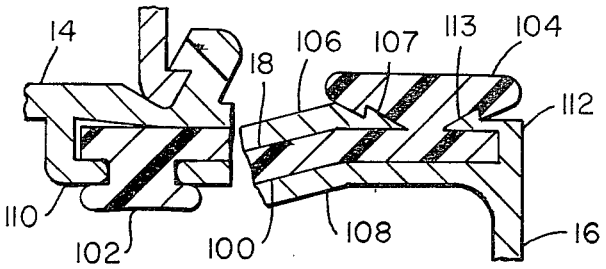
FIG. 3
FIG. 4
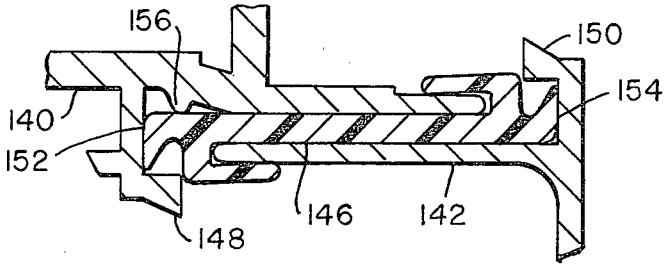
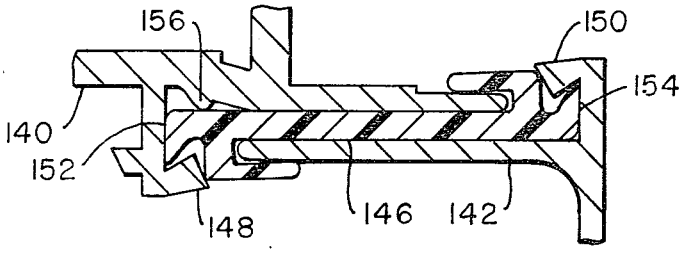
FIG. 5
FIG. 6
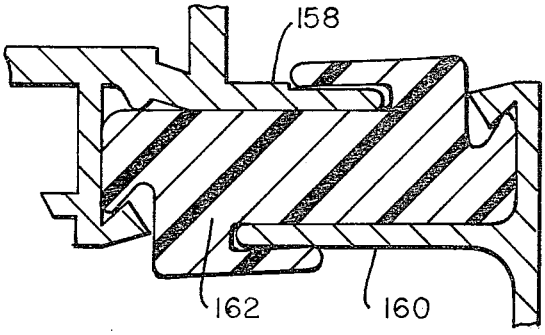
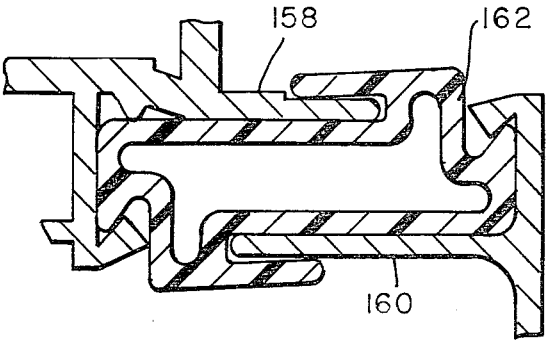
FIG. 7

WINDOW STRUCTURE

BACKGROUND OF THE INVENTION

1. Field of the Invention

The invention relates to a window structure which includes a window frame having inner and outer portions supporting inner and outer windows, each of which windows includes at least one movable sash therein wherein the frame portions are rigidly connected together through an insulating member providing a thermal break therebetween extending completely around the window structure. The window structure further includes a sash coupler connected to the movable sash of the inner window and operably associated with the movable sash of the outer window for selective engagement therewith to permit movement of the movable window sash together.

2. Description of the Prior Art

In the past, metal window structures of, for example, the single-hung type as disclosed in U.S. Pat. Nos. 3,711,995 and 3,795,076, have been provided with a single window frame extending from the inside to the outside of the opening which is to be closed by the window structure. With such structure, connsiderable heat will pass from the inside to the outside of the opening closed thereby due to passage of heat through the frame members. Other difficulties also arise with such structure, such as undesirable temperatures on the interior or exterior of the frame members, resulting in condensation of moisture in undesirable locations and the like.

Wherein thermal barriers have been provided in prior window frames between the interior and exterior thereof and the thermal barriers have extended completely through the frame members and around the frame, they have in the past often not imparted the required rigidity to the resulting total frame, or have been lacking in required insulating value.

Also, prior thermal barriers in window frames have sometimes required undesirable tolerances in one or both of the window frame portions and/or an insulating member therebetween.

In most window structures, such as those disclosed in the above United States patents, the inner window and outer window, where one is provided, are only movable separately. Wherein windows have been secured together in the past for opening and closing movement together, the structure securing them together has not been releasable without tools and automatically reengageable.

SUMMARY OF THE INVENTION

In accordance with the present invention, a thermal break window frame is provided in window structure in which an insulating member, which is variable in thickness and which may be solid or hollow, is used to rigidly connect separated inner and outer window frame portions. To this end, an insulating member having a cross section which is elongated transversely to the plane of the window structure is provided in conjunction with similarly elongated parts on the frame portions, which frame parts are positioned on each side of the elongated cross section of the insulating member in surface to surface contact therewith, as will be considered in more detail subsequently. The frame parts and insulating member are then rigidly secured together by snapping together mating parts, by staking, and/or crimping the frame parts.

The thermal break window frame structure of the invention further includes a unique sash coupler. The sash coupler of the invention is secured at one end to a movable sash of the inner window of the window structure and includes a recess in the other end thereof adapted to selectively receive a projection on a movable sash in the outer window of the window structure, whereby the movable sash may be selectively open and closed together.

BRIEF DESCRIPTION OF THE DRAWINGS

FIG. 1 is a broken vertical cross section of thermal break window structure constructed in accordance with the invention.

FIG. 2 is a broken horizontal cross section of the thermal break window structure illustrated in FIG. 1.

FIG. 3 is an enlarged cross section of the portion of the window structure illustrated in FIG. 2, within the circle 3 showing the insulating member staked to parts of the inner and outer frame portions of the thermal break window structure.

FIG. 4 is an enlarged partial cross section of a portion of modified window structure similar to that illustrated in FIG. 2 within the circle 3 showing frame members and an insulating member in assembly prior to roll forming the frame members to crimp the insulating member at the ends thereof to the frame members.

FIG. 5 is an enlarged partial cross section of the modified window structure illustrated in FIG. 4 after the frame members have been roll formed.

FIG. 6 is an enlarged partial cross section of a portion of further modified window structure similar to that illustrated in FIG. 2 within the circle 3 showing an enlarged insulating member providing a greater thermal barrier in the window structure.

FIG. 7 is an enlarged partial cross section of a portion of still further modified window structure similar to that illustrated in FIG. 2 within the circle 3 showing a hollow, enlarged insulating member providing an even greater thermal barrier in the window structure.

DESCRIPTION OF THE PREFERRED EMBODIMENT

The thermal break window structure 10 illustrated in FIGS. 1 and 2 includes a frame 12 having an inner, generally rectangular frame portion 14 and an outer, generally rectangular frame portion 16. The inner and outer frame portions 14 and 16 are connected together by an insulating member 18 which forms a thermal break between the inner and outer frame portions 14 and 16.

In more detail, the inner frame portion 14 includes head, jamb and sill members 20, 22 and 24 and check rail 30 having the cross sections illustrated in FIGS. 1 and 2 which form generally rectangular openings. The head, jamb and sill members are connected in miter joints at their ends. The check rail 30 is square cut and connected to jambs 22 at its ends.

The inner frame portion 14 supports a fixed thermal window panel 28 held in position in the frame by convenient means such as glazing strips 32. The inner frame portion 14 further supports the movable window sash 34 including the sash check rail 36, side rails 38 and lock rail 40. A glazing panel 42 is again secured in the sash 34 by convenient means such as the glazing strips 44, as shown. Weather stripping 46 and 48 as required is provided between sash 34 and frame portion 14.

The movable sash 34 is capable of moving vertically in the frame portion 14 and may be pivoted about the lock rail 40 thereof, as shown in the above referenced patents, the disclosure of which is incorporated herein by reference. As shown in the referenced patents, the window structure 10 may be used as single-hung, hopper, or glider window structure.

Jamb adapters 50 are utilized at each side of the fixed window panel 28 to aid in securing the fixed window panel 28 to the jambs 22 of the window frame portion 14 in a known fashion, again as set forth in the patents referenced above.

The outer frame portion 16 includes head, jamb and sill members 56, 58 and 60 and check rail 64, again having the cross section shown formed in rectangles with the head, jambs and sill connected in miter joints at their ends. The check rail 64 is square-cut and secured to jambs 58.

A fixed outer window sash 52 is secured to the portion 16 of the window frame 12 and includes a frame 54 secured in the head, jamb and check rail members 56, 58 and 60 by convenient means such as clips 26. A window panel 61 is secured in frame 54 by glazing strips 62.

A movable window sash 66, again including a frame 67 having sash check rail, jamb and lock rail members 68, 70 and 72 is positioned in the window frame portion 16 for movement vertically thereof. The window panel 73 is secured in frame 67 by glazing strips 75. It will be particularly noted that the lock rail 72 of the movable window sash 66 includes the projection 74 extending toward the lock rail 40 of window sash 34.

A screen 76 including frame members 78 and screen material 84 secured to the frame 78 by spline means 80 is removably positioned in the window frame portion 16, as shown, behind the extension 86 on the check rail 64 and the projections 88 on the sill 60 of the frame portion 16.

The insulating member 18 extends completely around the window frame 12 and is between the inner frame portion 14 and outer frame portion 16 in all positions thereof. The insulating member 18, as shown in FIGS. 1 through 4, has a cross section including an elongated central portion 100 and a pair of generally H-shaped end portions 102 and 104 on the opposite ends thereof. It will be noted that the ends of the elongated portion 100 forms the opposite one of the parallel portions of each of the H-shaped end portions 102 and 104.

It will be further noted that the cross sections of the heads, jambs and sills of the frame portions 14 and 16 each include one elongated part extending transversely of the plane of the window structure 10 which are designated 106 and 108 in FIGS. 2 through 4. These elongated parts are in surface to surface contact with the portion 100 of the insulating member 18 on opposite sides thereof as shown. The ends of the elongated parts 106 and 108 extend into the inner ends of the H-shaped portions 104 and 102 of the insulating member 18 as shown. In addition, each of the frame member cross sections has second shorter parts 110 and 112 extending into the opposite outer ends of the H-shaped portions 102 and 104 of the cross section of the insulating member 18, also as shown in FIGS. 2 through 4. The ends of frame parts 106 and 112 have barbs 107 and 113 thereon which cooperate with mating barbs on insulating member 18 to secure the frame portions 14 and 16 in assembly with insulating member 18.

With such construction, the insulating member 18 is securely locked between the inner and outer frame portions 14 and 16 and provides a thermal barrier therebetween. Further, with such structure the insulating member 18 rigidly secures the frame portions 14 and 16 together without requiring objectionable tolerances in either frame portion or the insulating member. Thus, the members have substantially no ability to rotate about an axis parallel to the longitudinal extent of the frame members. A most efficient insulating frame member 12 having a thermal break at the insulating member 18 is thus provided by the construction of the invention.

As shown best in FIGS. 4 and 5, modified frame members 140 and 142 are provided along with an insulating member 146 having a modified cross section. With the modified structure of FIGS. 4 and 5, the frame portions 148 and 150 may be roll formed when assembled as shown in FIG. 4 with the insulating member 146 to crimp the ends 152 and 154 of the insulating member 146 to the frame members 140 and 142.

The frame portions 148 and 150 are roll formed into the configuration illustrated in FIG. 5 to complete the securing of the insulating member 146 to the frame members 140 and 142. Note particularly that the projection 156 has been provided on the frame member 140 to assure adequate crimping of the ends 152 and 154 of the insulating member 146 to the frame 140.

A tighter, more waterproof thermal barrier is provided with the crimped construction of FIGS. 4 and 5 than is possible with the snap-in construction of FIGS. 1 and 2.

If a greater thermal barrier is required between the frame members, a construction such as the modified construction illustrated in FIG. 6 may be used. The structure of FIG. 6 is essentially the same as that of FIGS. 4 and 5 except that the frame members 158 and 160 and the insulating member 162 have modified cross sections with the insulating member 162 being thicker. With such thicker cross section, the effectiveness of the thermal barrier will be increased. As will be readily understood, the ultimate thickness of the insulating member 162 will depend upon the thermal barrier requirements and the capability of the material of which the insulating member is constructed to produce a thermal barrier which has the desired rigidity.

As shown further in FIG. 7, the insulating member 164 may be hollow, wherein the thickness of the insulating member and the rigidity requirements thereof permit. The hollow insulating member 164 provides the added thermal barrier of the air gap and reduces heat conductivity through the insulating member.

In the embodiments of the invention shown in FIGS. 1 through 7, the frame parts may be aluminum, while the insulating members may be relatively rigid polyvinyl chloride.

A sash coupler 120 having a cross section as shown in FIG. 1 is secured to the lock rail 40 of the movable window sash 34 by convenient means such as screws 122 at one end 124 thereof. The other end 126 has a generally U-shaped cross section including oppositely inclined legs 128 and 130 and a flexible connecting portion 132. The leg 130 is extended as shown at 134 to provide handle structure for releasing the sash coupler 120, as desired. Mating hook portions 135 and 137 are provided on the ends of projection 74 and leg 130 to prevent unintentional disengagement of the sash coupler 120.

In operation of the sash coupler 120 with the sash coupler positioned as shown in FIG. 1, wherein the projection 74 of the sash lock rail 72 is within the recess 136, the outer movable sash 66 may be moved vertically with the inner movable sash 34. If it is desired to disengage the movable sash to operate the inner movable sash or outer movable sash independently, the handle portion 134 of the sash coupler is grasped and moved upwardly to pivot the leg 130 of the sash coupler clockwise as shown about the flexible connecting portion 132 after which the inner movable sash member 34 may be moved into an open position independently of the outer movable sash to permit independent movement of the outer movable sash. When it is desired to connect the inner movable sash 34 to the outer movable sash 66, again it is only necessary to cam the leg 130 of the sash coupler over the projection 72 by moving the inner movable sash downward toward the projection 72 to place the projection 74 in the recess 136 again.

The sash coupler 120 is thus seen to be particularly simple in that it is a short length of a single extrusion having a relatively simple cross section. The sash coupler 120 is thus easy to produce and economical. Further, as will be readily apparent from the operation of the sash coupler 120, it is not easily accidentally disengaged and is capable of disengagement and re-engagement without use of tools.

While one embodiment of the invention and modifications thereof have been considered in detail, it will be understood that other embodiments and modifications thereof are contemplated by the inventor. It is the intention to include all embodiments and modifications as are defined by the appended claims within the scope of the invention.

What I claim as my invention is:

1. Thermal break window structure including a generally rectangular outer frame portion, a generally rectangular inner frame portion, and an insulating member positioned between the inner and outer frame portions and cooperable therewith for rigidly securing the frame portions together without contact between the frame portions, said insulating member having a cross section including an elongated straight central portion extending transversely of the plane of the window structure, said insulating member extending through the frame parallel to the plane of the window only in off set locations separated by the extent of the elongated central portion of the insulating member and defined by the frame portions and said insulating member including an H-shaped portion at both ends of the central portion having opposite parallel parts in common with the central portion and the frame members have a cross section including a pair of parallel spaced parts, one of which is longer than the other, the longer of which parts extend on opposite sides of the central portion of the H-shaped cross section of the insulating member and between the parallel parts of the H-shaped portions of the insulating member at the inner ends thereof.

2. Structure as set forth in claim 1, wherein the shorter of the parts of the frame portion's cross sections are positioned between the parallel parts of the H-shaped portions of the insulating member at the outer ends thereof.

3. Structure as set forth in claim 1, wherein the elongated central portion of the insulating member cross section and the parts of each of the frame portions extending parallel to and in engagement therewith on opposite sides thereof are staked together to secure the frame portions and insulating member together.

4. Structure as set forth in claim 1, wherein the shorter of the parallel spaced parts of the frame members cross section have roll formed ends crimping the ends of the cross section of the insulating member against the longer of the parallel spaced parts.

5. Structure as set forth in claim 1, wherein the thickness of the central portion of the insulating member cross section is greater than the thickness of the frame members and is variable in accordance with the insulation required.

6. Structure as set forth in claim 1, wherein the central portion of the insulating member is hollow.

7. Structure as set forth in claim 1, wherein the thermal break window structure includes an inner window and an outer window, each including corresponding movable sash and further including sash coupler means extending between the inner and outer movable sash for selectively moving the movable sash together in one direction and necessarily moving the movable sash together in the opposite direction after alignment of the inner and outer window.

8. Thermal break window structure including a generally rectangular outer frame portion, a generally rectangular inner frame portion, and an insulating member positioned between the inner and outer frame portions and cooperable therewith for rigidly securing the frame portions together without contact between the frame portions, said insulating member having a cross section including an elongated straight central portion extending transversely of the plane of the window structure and including an H-shaped portion at both ends of the central portion having opposite parallel parts in common with the central portion, said frame members having a cross section including a pair of parallel spaced parts, one of which is longer than the other, the longer of which parts extend on opposite sides of the central portion of the H-shaped cross section of the insulating member and between the parallel parts of the H-shaped portions of the insulating member at the inner ends thereof.

9. Window structure as set forth in claim 1, including an inner window and an outer window, each including corresponding movable sash and sash coupler means extending between the inner and outer movable sash for selectively moving the movable sash together in one direction and necessarily moving the movable sash together in the opposite direction after alignment of the inner and outer window.

10. Structure as set forth in claim 9, wherein the sash coupler is constructed and arranged to be readily disengaged without tools, to be difficult to accidentally disengaged, and is automatically re-engaged on movement of the movable window panels into a predetermined position.

11. Thermal break window structure including a generally rectangular outer frame portion, a generally rectangular inner frame portion and an insulating member positioned between the inner and outer frame portions and cooperable therewith for rigidly securing the frame portions together without contact between the frame portions, said thermal break window structure further including an inner window and an outer window each including corresponding movable sash and further including a sash coupler extending between the inner and outer movable sash whereby the movable sash may be selectively moved together, wherein one end of the sash coupler is secured to the inner movable window sash and the outer end of the sash coupler defines a recess selectively receiving a projection on the outer window sash extending toward the inner window sash, the recess being formed by a generally U-shaped portion on the outer end of the sash coupler having a flexible disconnecting portion, and one leg of the U-shaped cross section of the outer end of the sash coupler being inclined with respect to the projection on the outer movable window sash whereby on movement of the one end of the sash coupler past the projection on the outer window movable sash the one leg of the U-shaped cross section of the outer end of the sash coupler is cammed over the projection into the recess to automatically secure the sash coupler to the outer window movable sash.

12. Structure as set forth in claim 11, wherein the sash coupler is constructed and arranged to be readily disengaged without tools, to be difficult to accidentally disengaged, and to be automatically re-engaged on movement of the movable window panels into a predetermined position.

13. Window structure including an inner window and an outer window, each including corresponding movable sash and a sash coupler extending between the inner and outer movable sash whereby the movable sash may be selectively moved together, wherein one end of the sash coupler is secured to the inner movable window sash and the outer end of the sash coupler defines a recess selectively receiving a projection on the outer window sash extending toward the inner window sash, the recess being formed by a generally U-shaped outer end of the sash coupler having a flexible connecting portion, and one leg of the U-shaped cross section of the outer end of the sash coupler being inclined with respect to the projection on the outer movable window sash whereby on movement of the one end of the sash coupler past the projection on the outer window movable sash the one leg of the U-shaped cross section of the outer end of the sash coupler is cammed over the projection into the recess to automatically secure the sash coupler to the outer window movable sash.

* * * * *